US006499669B2

(12) United States Patent
Ganser

(10) Patent No.: US 6,499,669 B2
(45) Date of Patent: Dec. 31, 2002

(54) FUEL INJECTION VALVE FOR INTERNAL COMBUSTION ENGINES

(75) Inventor: Marco A. Ganser, Zurich (CH)

(73) Assignee: CRT Common Rail Technologies AG, Neuhausen (CH)

( * ) Notice: Subject to any disclaimer, the term of this patent is extended or adjusted under 35 U.S.C. 154(b) by 8 days.

(21) Appl. No.: 09/764,435

(22) Filed: Jan. 19, 2001

(65) Prior Publication Data

US 2001/0013556 A1 Aug. 16, 2001

(30) Foreign Application Priority Data

Jan. 19, 2000 (CH) ..... 0092/00

(51) Int. Cl.[7] ..... F02M 41/16
(52) U.S. Cl. ..... 239/96
(58) Field of Search ..... 239/88, 96

(56) References Cited

U.S. PATENT DOCUMENTS 4,826,080 A 5/1989 Ganser
5,655,716 A 8/1997 Mathis
5,685,483 A * 11/1997 Ganser ..... 137/624.13
5,842,640 A * 12/1998 Ganser ..... 137/624.13
6,293,254 B1 9/2001 Crofts et al.

* cited by examiner

*Primary Examiner*—Lesley D. Morris
(74) *Attorney, Agent, or Firm*—Oblon, Spivak, McClelland, Maier & Neustadt, P.C.

(57) ABSTRACT

An injection valve member for the closing and opening of injection orifices of a valve seat element is installed longitudinally adjustably in a central housing bore of a fuel injection valve. The opening and closing movement sequence of the injection valve member is controlled by a control device. A control piston operatively connected to the injection valve member is loaded, on the one hand, by the fuel system pressure prevailing in a high-pressure zone and, on the other hand, by the fuel control pressure in a control space. The high-pressure zone includes the central housing bore which is closed off sealingly by a control body fixed to the housing. The control space is arranged between the control body and a piston end face and is at least temporarily delimited radially by a control sleeve which is moveable transversely to the longitudinal axis of the housing. A narrow sliding guide between a control piston part and the control sleeve, said sliding guide separating the control space from the high-pressure zone, forms an accurate longitudinal guide for the control sleeve. The fuel injection valve is simple in terms of manufacture and assembly.

23 Claims, 7 Drawing Sheets

FUEL INJECTION VALVE FOR INTERNAL COMBUSTION ENGINES

BACKGROUND OF THE INVENTION

1. Field of the Invention

The invention relates to a fuel injection valve for the intermittent injection of fuel into the combustion space of an internal combustion engine.

2. Discussion of the Background

EP-B-0 228 578 describes a fuel injection valve with an injection valve member which is guided longitudinally displaceably in a housing in a bore extending in the direction of the longitudinal axis of the housing. This bore, which is connected via a throttle to a fuel high-pressure connection and is designed as an accumulator space, is closed off, at one end, by a seat for the injection valve member, said seat being provided with injection orifices, and, at the other end, by a cylindrical end piece which is guided in the housing by means of a narrow guide performing a sealing function. The end piece serves as a narrow sliding guide for a piston which forms part of the one-piece injection valve member. The injection valve member is narrowly guided in a further guide in the vicinity of the seat. The movement of opening and closing the injection valve member is controlled by controlling the pressure in a control space above the piston of the injection valve member.

As mentioned, the two guides for the one-piece injection valve member a produced in the form of narrow sliding fits, which means that these guides have to be accurately oriented axially, so that no lateral forces are exerted on the injection valve member, which could cause distortion of the latter, severe friction or even jamming and would impair the functioning of the fuel injection valve. The fuel injection valve is consequently complicated to manufacture and assemble. Moreover, the housing has a relatively large cross section, because, as mentioned, the central bore is designed as an accumulator space, this being a disadvantage for installation in internal combustion engines.

A generic fuel injection valve of the type initially mentioned is known, for example, from EP-B-0 686 763. In this fuel injection valve, the opening and closing movement sequence of an injection valve member installed longitudinally adjustably in a housing is controlled by means of a control device comprising a control piston which is a component separate from the injection valve member and operatively connected to the latter. Between the end face of the control piston and a control body fixed to the housing is located a control space which is delimited radially by a control sleeve. The control sleeve is arranged displaceably and with a narrow sliding fit in a housing bore receiving the control device. The control piston is likewise guided with a narrow sliding fit in the control sleeve. High-pressure supply lines are arranged parallel to the housing bore, in which the control device is accommodated, in the housing and are connected to a fuel high-pressure connection. One high-pressure supply line leads to the control device, the control space being connected to this high-pressure supply line via an inlet throttle connection. By an outlet orifice in the control body being opened or closed (by means of a controllable pilot valve), the fuel control pressure in the control space, which acts on the control piston, is capable of being controlled. The other high-pressure supply line leads to an annular space and to injection orifices of a valve seat element arranged at the lower end of the fuel injection valve. The injection valve member is accurately guided in a bore of the valve seat element by means of a component which is arranged above the annular space and on which the fuel system pressure acts from below.

So that the high-pressure supply lines can be accommodated in the housing, the latter must have a relatively large cross section, and this proves to be a disadvantage for installation in internal combustion engines on grounds of space.

The housing bore, in which the multi-piece injection valve member runs, is connected in this middle part to a fuel return line. This means that a low fuel pressure prevails in this region of the housing bore. This leads to leakages out of the adjoining regions, in which the fuel high pressure prevails, into this low-pressure region of the housing bore.

SUMMARY OF THE INVENTION

The object on which the present invention is based is to provide a fuel injection valve which is simple and cost-effective in terms of manufacture and assembly, in which at most insignificant leakages occur and which, even in its external shape, is advantageous for installation in internal combustion engines.

This object is achieved, according to the invention, by means of a fuel injection valve having the features of the independent claims set forth herein.

The fuel injection valve according to the invention not only has a simple and cost-effective makeup. Its special advantages are also that functional identity can be achieved in a simple way in all the valves of an internal combustion engine, since, in all components, the tolerances as regards both manufacture and assembly can be adhered to without difficulty. Dispensing with lateral high-pressure supply lines in the housing makes it possible to have a slender configuration of the fuel injection valve, this being advantageous for installation in internal combustion engines. The central bore which is located in the housing and in which the fuel high pressure prevails forms a completely leaktight region, so that leakages into spaces with lower pressure are virtually eliminated.

Preferred developments of the fuel injection valve according to the invention form the subject-matter of the dependent claims.

A fuel injection valve of the type initially mentioned, with a particularly preferred embodiment of the control device, forms the subject-matter of the independent claim 20.

BRIEF DESCRIPTION OF THE DRAWINGS

The invention is explained in more detail below by means of the drawings in which.

DETAILED DESCRIPTION OF THE PREFERRED EMBODIMENTS

Figure 1:
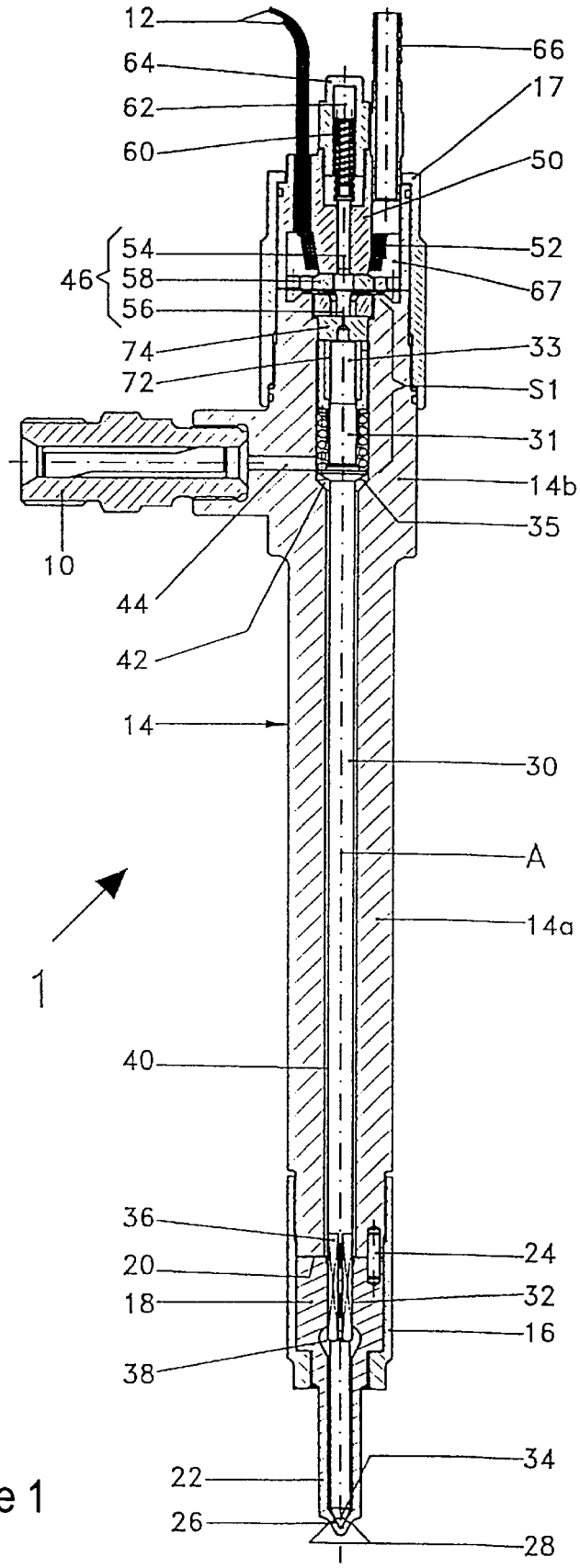
FIG. 1 shows a first exemplary embodiment of a fuel injection valve in longitudinal section.

According to FIG. 1, a fuel injection valve 1 is connected via a fuel high-pressure connection 10 to a high-pressure feed device, not illustrated in the drawing, which delivers fuel at a pressure of 100 to 2000 bar and above. The fuel injection valve 1 is connected, furthermore, to an electronic control, likewise not shown, via electric connections 12.

The fuel injection valve 1 has a housing 14 which comprises a lower housing part 14*a* and an upper housing part 14*b*. The lower housing part 14*a* has a tubular configuration, is long, is narrow in diameter and has a central bore 40 coaxial to the longitudinal axis A of the fuel injection valve 1. The central bore 40 is widened in the region of the upper housing part 14*b*. This bore of larger diameter is designated by 42 in FIG. 1. A passage bore 44 connecting the fuel high-pressure connection 10 to the widened part 42 of the central bore is arranged radially to the longitudinal axis A.

The lower housing part 14*a* is connected at its lower end to a screwed-on holding part 16 produced in the form of a union nut. The holding part 16 presses a nozzle body 18 sealingly onto a lower surface 20 of the housing part 14*a*. The radial position of the nozzle body 18 relative to the housing part 14*a* is fixed by means of one or more pins 24 which also prevent twisting. A nozzle tip 22 of the nozzle body 18, said nozzle tip forming a valve seat element, projects out of the holding part 16. The nozzle tip 22 is provided with a nozzle needle seat 26 and with a plurality of injection orifices 28. The injection orifices 28 are capable of being closed off by means of a lower end 34 of an axially adjustable nozzle needle 30 forming an injection valve member. The nozzle needle 30 extends upward from the lower nozzle needle seat 26 through an annular space 38 and a bore 32 of the nozzle body 18 and also through the central bore 40 of the housing part 14*a* and in the upper end part has a collar 35 and two piston parts 31, 33. These piston parts 31, 33 form part of a control device S1 for controlling the adjustment movement of the injection valve member, that is to say of the nozzle needle 30. The control device S1 is described in detail further below by means of FIGS. 2 and 3. In the region of the nozzle body bore 32, the nozzle needle 30 is provided with axially running ground-down surfaces 36 which connect to the annular space 38 hydraulically to the central bore 40 of the housing part 14*a*.

In the exemplary embodiment illustrated in FIG. 1, the nozzle needle 30 is produced in one piece. However, the nozzle needle could also consist of a plurality of elements operatively connected to one another.

A holding nut 17 is screwed onto the upper housing part 14*b*. Inside the holding nut 17 is accommodated an electromagnetically actuable pilot valve 46 which comprises an armature 58 fixably connected to a pilot valve stem 54. When an electromagnet 50 is in a currentless state, the pilot valve stem 54 is pressed downward by the force of a compression spring 60. The magnitude of this force is capable of being set by means of a spring tensioning element 62. For actuating the pilot valve 46 or for raising the pilot valve stem 54 connected to the armature 58, control pulses are supplied by the electronic control, via the electric connections 12, to an exciting coil 52 of the electromagnet 50, said exciting coil being assigned to the armature 58.

The spring tensioning element 62 is accommodated in a closing-off part 64 which sealingly closes off the fuel injection valve 1 at its upper end. Installed, together with the electromagnet 50, in the holding nut 17 is a fuel return connection 66 connected to a space 67 which surrounds the pilot valve 46 and is a so-called low-pressure zone in which fuel of low pressure flows.

The control device S1, then, is described with reference to FIGS. 2 and 3.

Figure 2:
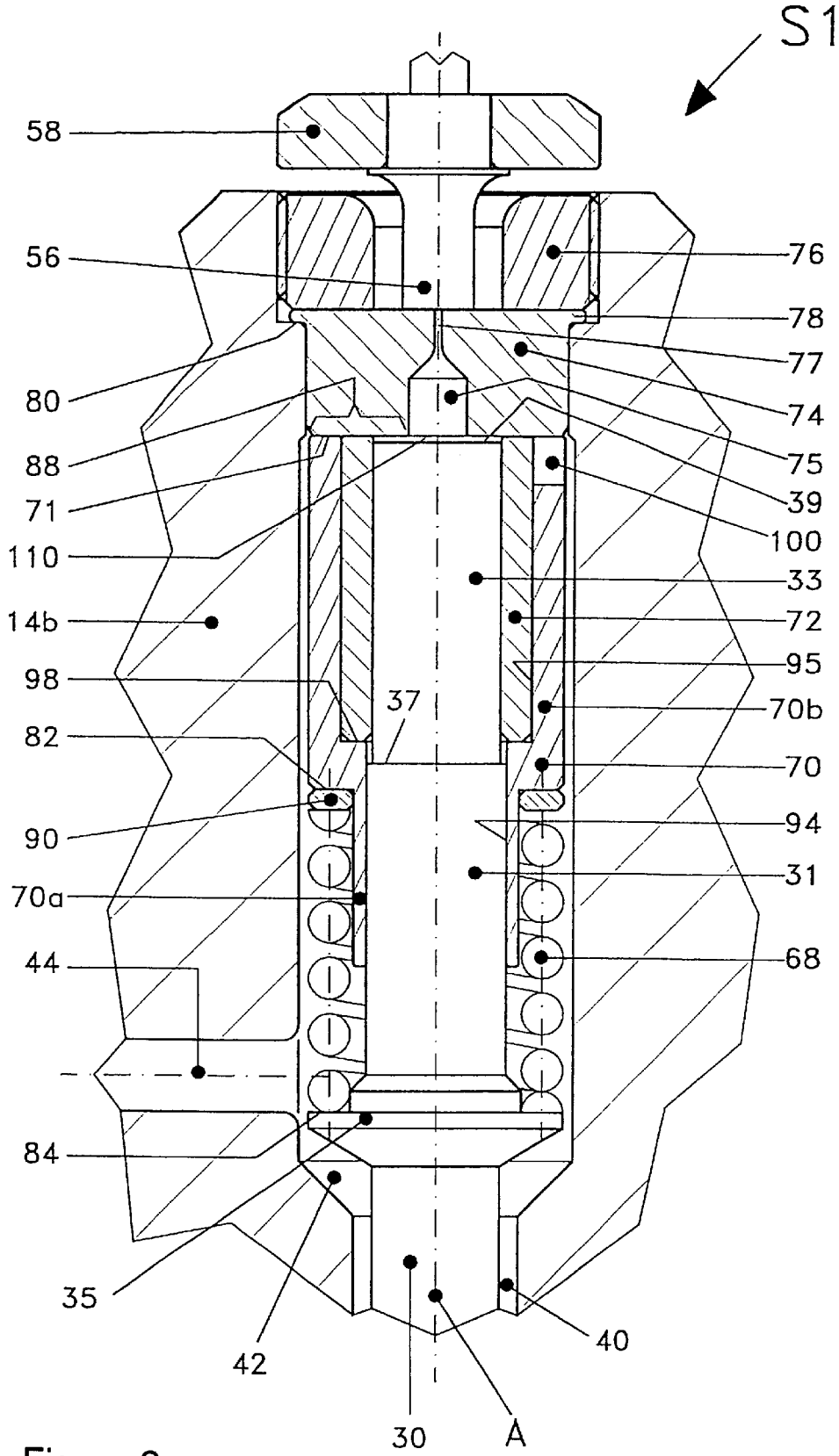
FIG. 2 shows, on an enlarged scale and in longitudinal section, part of the fuel injection valve shown in FIG. 1, with the first embodiment of a control device.

Pressed sealingly into the widened bore 42 in the upper housing part 14*b* is a control body 74 which lies with a flange 78 on a housing step surface 80 and which is fixed axially by means of a retaining nut 76 (FIG. 2). Sealing off between the bore 42 and the control body 74 could, of course, also be implemented differently, and, instead of a press fit, for example, suitable sealing rings could assume the sealing-off function. The control body 74 has an outlet bore 75 tapering at the top into an outlet orifice 77. The lower end face of the control body 74 is designated by 88. A sleeve-shaped spacer part 70 is pressed with its upper annular end face 71 onto this lower end face 88 by means of a closing spring or nozzle needle spring 68. The nozzle needle spring 68 is prestressed between a lower step surface 82 of the spacer part 70 (or a spacer disk 90 bearing on said step surface) and an upper step surface 84 of the nozzle needle collar 35. The prestressing force of the nozzle needle spring 68, which is to hold securely the nozzle needle 30 downwardly in the closing direction of the fuel injection valve 1 counter to the fuel high pressure exerted on the nozzle needle 30, must be relatively high and may amount, for example, to 100 to 300 N. The prestressing force of a plurality of fuel injection valves of an internal combustion engine must coincide exactly, in order to ensure functional identity. The respective manufacturing tolerances can be compensated by means of the spacer disk or spacer disks 90.

The injection valve member or the nozzle needle 30 has a first piston part 31 adjoining the collar 35 and a second piston part 33 stepped in diameter relative to said first piston part. The second piston part 33 has an upper end face 39. The annular step surface between these two piston parts 31, 33 is designated by 37. As is evident, in particular, from FIG. 3, the first piston part 31 projects with some radial play R1 into a lower part 70*a* of the spacer part 70. The inner cylindrical guide surface of this part 70*a* for the piston part 31 is designated by 94. The spacer part 70 has, furthermore, an upper part 70*b* of widened diameter. The step surface 82 already mentioned is present between the two parts 70*a* and 70*b* of the spacer part 70. Arranged inside the spacer part 70, at a distance from the step surface 82, is an inner step surface 98 which connects the cylindrical guide surface 94 to a further cylindrical guide surface 95 of larger diameter. This step surface 98 is located above the step surface 37 present between the two piston parts 31, 33. The second piston part 33 is surrounded by a control sleeve 72, the cylindrical outer surface 72*a* of which is assigned with some radial play R2 to the guide surface 95 of the spacer part 70 (cf. FIG. 3). This radial play R2 may (in a similar way to the radial play R1 between the first piston part 31 and the guide surface 94) amount to approximately between 6 and 50 $\mu$m (micrometers). By contrast, a narrow sliding fit, that is to say a radial play R0 of only 1 to 8 $\mu$m, is provided between the inner surface 72*i* of the control sleeve 72 and the outer surface of the second piston part 33. Since the pressure is the same everywhere (both on the inside and on the outside of the control sleeve 72 and of the spacer part 70), no pressure-induced deformations of the control sleeve 72 and of the spacer part 70 occur and the radial plays R0, R1, R2 and also the gap S remain the same, irrespective of the pressure level.

In an alternative embodiment, not shown, of the control device S1, the radial plays R1 and R2, which extend over the respective length of the parts, are replaced by one or more ribs with some radial play. These ribs could be attached either to the respective insides of the spacer part 70 or to the outer cylindrical surface 72*a* of the control sleeve 72 and to the outer cylindrical surface of the first piston part 31. The flow caused by the ribs is independent of the fuel viscosity (that is to say, of its temperature), which is not the case where elongated radial plays are concerned. The independence of the flow from the viscosity may signify a functional benefit. (The radial plays R1 and R2 could also be implemented in the same way in the control devices S2 and S3 described further below.)

The axial length of the control sleeve 72 is smaller by a small amount S, which amounts, for example, to 5 to 40 $\mu$m, than the distance between the inner step surface 98 of the spacer part 70 and its upper annular end face 71. FIG. 3 shows the control sleeve 72 in a position in which the lower end face 72*u* of the control sleeve 72 lies on the inner step surface 98 and a gap S is thereby formed between the upper end face 72*o* of the control sleeve and the lower end face 88 of the control body 74 (in FIG. 3, the gap S is illustrated as exaggeratedly large; in reality, this gap S is about ten times smaller than the nozzle needle stroke). At the same time, the lower end face 72*u* closes off from above a space 106 which is radially delimited by the second piston part 33, on the one hand, and by the guide surface 94 of the spacer part 70, on the other hand, and which is axially delimited downwardly by the step surface 37 between the two piston parts 31, 33.

The spacer part 70 has a passage 100 at its upper end. As is clear from FIG. 3, the upper end face 72*o* of the control sleeve 72 is provided with a radial depression 102 (or a plurality of radial depressions). The passage 100 and the depression 102 connect the space enclosed by the housing bore 42, that is to say the high-pressure zone connected to the fuel high-pressure connection 10 via the passage bore 44, to a control space 110 arranged above the second piston part 33. This control space 110, radially delimited in the lower region by the guide surface 95 of the spacer part 70 and in the upper region by the outlet bore 75 and the outlet orifice 77, can be kept closed or opened at the top by means of the pilot valve stem 54. The flat seat part of the pilot valve stem 54, by means of which the outlet orifice 77 can be closed, is designated by 56 in FIGS. 1 to 3.

Figure 3:
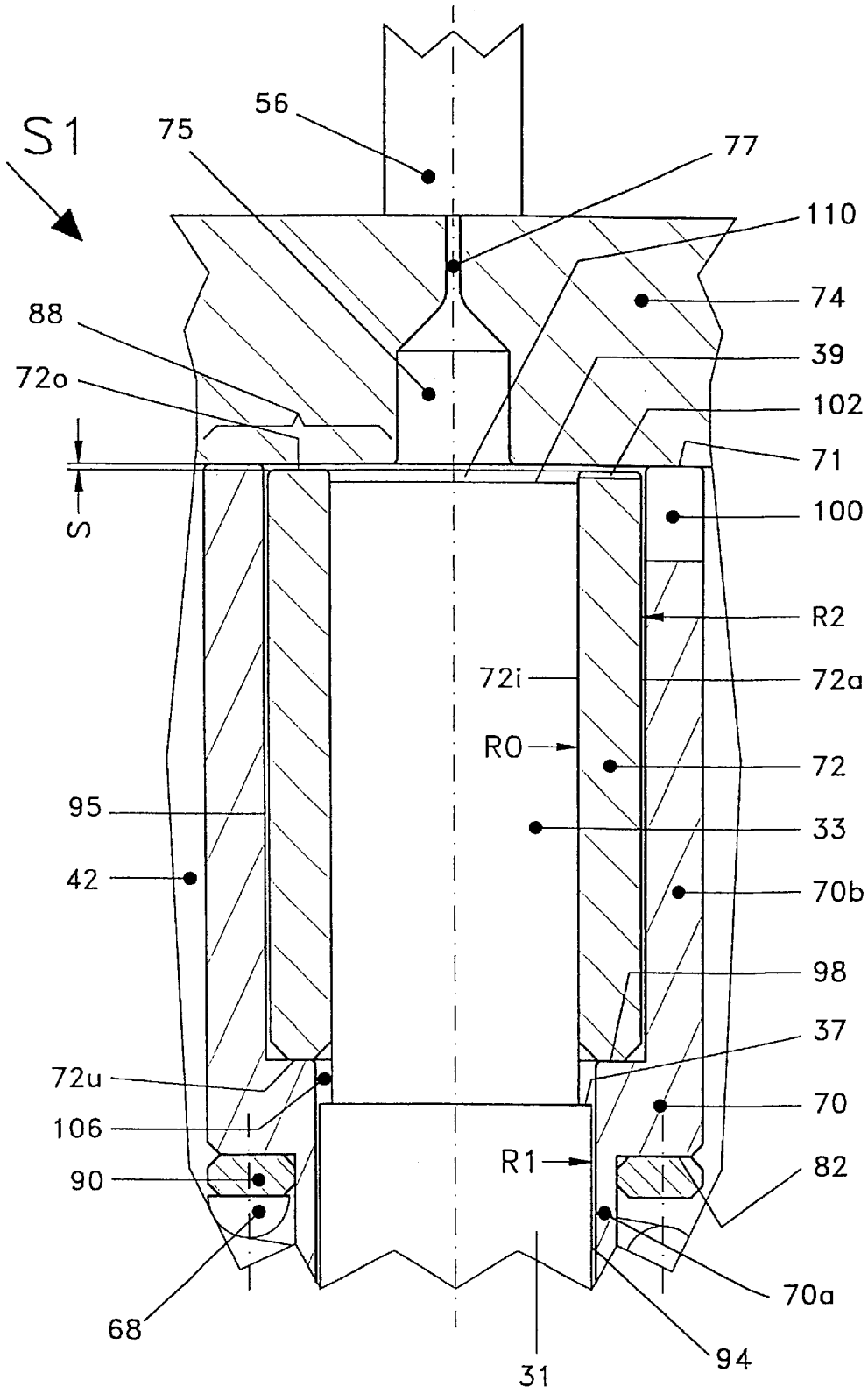
FIG. 3 shows part of the control device according to FIG. 2 on a further-enlarged scale.

FIGS. 1 to 3 show the fuel injection valve 1 in a position prior to the injection operation. The same high pressure prevails in the control space 110, closed by the flat seat part 56 of the pilot valve stem 54, as in the high-pressure zone, that is to say as in the space which is enclosed by the housing bores 42, 40 and by the bore 32 and which extends via the annular space 38 as far as the nozzle needle seat 26 and surrounds the nozzle needle 30 and, in the upper region, the spacer part 70. The space 106 delimited by the step surface 37, on the one hand, and by the lower end face 72*u*of the control sleeve 72 is also connected to the high-pressure zone via the radial gap R1 between the first piston part 31 and the guide surface 94. The control sleeve 72 is in neutral equilibrium, in which all the hydraulic forces are compensated. The control space 110 is connected to the high-pressure zone via the gap S between the lower end face 88 of the control body 74 and the upper end face 72*o* of the control sleeve 72 and via the depression 102. In this position, it is the nozzle needle spring 68 which holds the nozzle needle 30 in its lower closing position, while the pressure force, which, with the nozzle needle 30 open, acts below the nozzle needle seat 26 in the opening direction of the nozzle needle 30, is absent.

As soon as a pulse of selected duration is imparted to the electromagnet 50 via the electronic control, the armature 58 is pulled up counter to the force of the compression spring 60 and consequently the pilot valve stem 54 of the pilot valve 46 is raised. The flat seat part 56 of the pilot valve stem 54 releases the outlet orifice 77 of the control body 74. The pressure in the control space 110 falls somewhat. The hydraulic equilibrium with regard to the control sleeve 72 is thereby disturbed, and a hydraulic force acts on the control sleeve 72 in the direction of the control body 74, so that said control sleeve is moved toward the lower end face 88 of the latter. At the same time, the lower end face 72*u* of the control sleeve 72 is lifted away from the step surface 98 and the gap S is formed at this point, a small fuel quantity being supplied, via the gaps R1 and R2, to the space 106 which is slightly enlarged because of the control sleeve 72 being moved upward. The control space 110 is still connected to the high-pressure zone only via the depression 102, with the result that the pressure in the control space 110 falls more sharply. The injection operation commences. While the nozzle needle 30 is executing the opening movement, fuel is displaced continuously in the control space 110 via the outlet orifice 77 and in the space 106 via the gaps R1 and R2. A particular overpressure with respect to the high-pressure zone prevails in the space 106 and, via the surface 72*u*, presses the control sleeve 72 onto the lower end face 88 of the control body 74.

In order to terminate the injection operation, the pilot valve 46 is moved into its closing position via the electromagnet 50, once again by electronic control. Since the outlet orifice 77 is then closed again, fuel replenishment via the depression 102 acting as an inlet throttle causes the pressure in the control space 110 to rise quickly, said pressure acting on the upper end face 39 of the second piston part 33. The nozzle needle spring 68 moves the nozzle needle 30 downward in a closing direction, with the result that an underpressure, as compared with the remaining high-pressure zone, is then generated in the space 106 becoming larger, the consequence of this being that the control sleeve 72 undergoes a hydraulic force away from the lower end face 88 of the control body 74 and releases the gap S again at the top. This produces a rapid pressure rise in the control space 110 due to the fuel which flows via the passage 100 and the gap S, present once again, and also the depression 102 into the control space 110 and which allows a substantially quicker termination of the injection operation than if the filling of the control space 110 were to take place solely via the depression 102.

Since, even before the commencement of the injection operation, the control sleeve 72 closes the direct connection of the control space 110 to the high-pressure zone via the gap S, the fuel control stream flowing out through the outlet orifice 77 into the low-pressure space 67 and into the fuel return connection 66 is appreciably reduced in an advantageous way. This takes place merely via the depression 102, which may almost be as small as desired, since its function is merely, during the closing of the outlet orifice 77, to bring about the initial pressure buildup in the control space 110 so as to restore the gap S at the top on the control-body side. In principle, instead of a precision-manufactured upper end face 72*o* provided with a depression 102, an end face which is less precise (or relatively approximate and therefore less complicated to manufacture) and has some leakages could be used, in which case the leakages would assume the inlet throttle function of the depression 102.

The gap S can be manufactured accurately by simple means. As already mentioned, the gap S is defined by the difference in length of the control sleeve 72 and of the distance between the step surface 98 of the spacer part 70 and its end face 71. That is to say, this gap S is set prior to assembly and, in the assembled fuel injection valve 1, is maintained exactly, and independently of the high-pressure level, since the planar lower end face 88 of the control body 74 is common to the spacer part 70 and to the control sleeve 72 and the pressure conditions before and after the injection are compensated, with the result that no pressure-induced deformations, dependent on the high-pressure level, of these control elements occur. In other words, the gap S is preserved, even after assembly, without any readjustment.

It would also be possible, however, for the lower end face 88 of the control body 74, on which end face the spacer part 70 bears with its end face 71, to be provided with a depression, and for the travel S for the longitudinal adjustment of the control sleeve 72 to be defined by the difference between the control sleeve length and the distance between the step surface 98 and the base surface of the depression. In such a variant, not illustrated in the drawing, for example, the control sleeve 72 could then be of exactly the same length as the distance between the step surface 98 and the end face 71 of the spacer part 70.

In the control device S1 according to the invention, the control sleeve 72 and the spacer element 70 are not axially centered exactly, that is to say not fixed radially in the central housing bore 42, but, instead, are movable transversely to the longitudinal axis A of the housing 14. Some radial offset of the control piston 31, 33 relative to the nozzle needle seat 26 for the injection valve member or the nozzle needle 30 is thereby possible, without at the same time lateral forces being exerted on the nozzle needle 30, which could lead to the distortion of the latter, to the generation of severe frictional forces or to jamming and could impair the functioning of the fuel injection valve. The nozzle needle 30 can be adapted to the radial offset and is free of lateral forces.

Moreover, only a single accurate fit is necessary: that between the outer surface of the second piston part 33 and the inner surface 72*i* of the control sleeve 72 (designated by R0 in FIG. 3). However, even this accurate fit needs to be less exact than those according to EP-B-0 686 763, since, as already mentioned, no pressure-induced deformations, dependent on the pressure level, of the elements of the control device S1 occur. All other fits may even be wider, thus entailing an additional advantage in manufacturing terms. The housing 14 of the fuel injection valve 1 according to the invention does not have to b e provided anywhere with an exact guide, at which friction and consequently wear would also occur, that is to say the housing 14 does not have to be hardened.

A further essential advantage of the fuel injection valve 1 according to the invention is that the high-pressure zone, that is to say the space and the passage bore 44 concentrically surrounding the nozzle needle 30 from the nozzle needle seat 26 via the annular space 38 and the housing bores 40, 42, and the control space 110 as far as the outlet orifice 77, also forms a completely leaktight region without any leakage points.

The housing 14 of the fuel injection valve according to the invention can have a very slender design, this being advantageous for the installation of the fuel injection valve into the cylinder head of the internal combustion engine.

Figure 4:
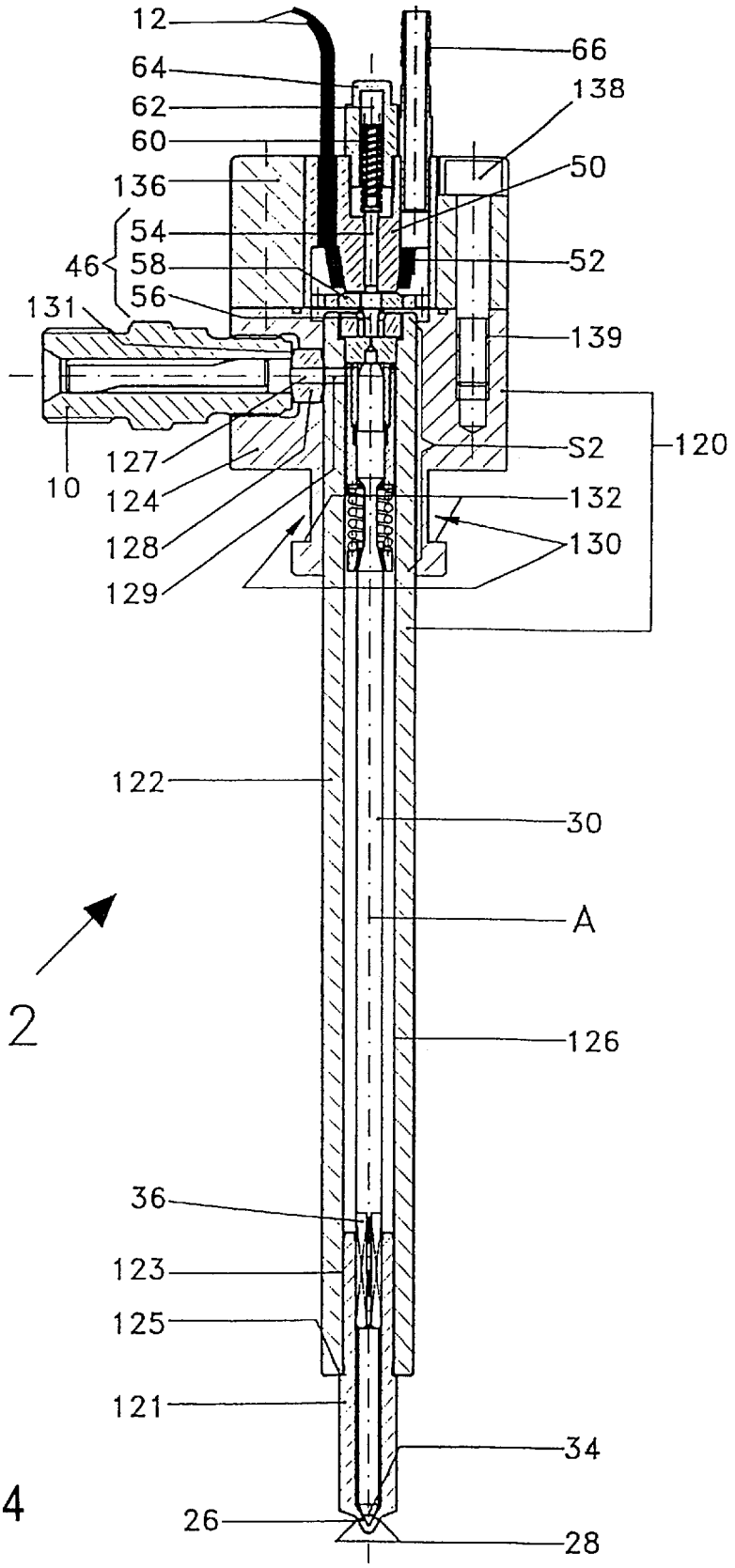
FIG. 4 shows, in longitudinal section, a second exemplary embodiment of a fuel injection valve with a second embodiment of the control device.

FIG. 4 shows a second exemplary embodiment of a fuel injection valve 2. The parts which are already known from FIGS. 1 to 3 and remain the same are designated by the same reference numerals in FIG. 4. In contrast to the fuel injection valve 1 according to FIGS. 1 to 3, t he housing 120 of the fuel injection valve 2 consists of two mutually assembled parts 122, 124. The first part 122, out of which, at its lower end, a nozzle tip 121 provided with the nozzle needle seat 26 and with a plurality of injection orifices 28 projects once again, is designed as a long slender tubular piece which projects with its upper part into the second housing part 124 and is connected to the latter, as described in more detail further below. The nozzle tip 121 is pressed from below, with a press fit 123, into the housing bore 126 of the housing part 122 and is positioned axially by means of a step surface 125. In comparison with the fuel injection valve 1, the union nut 16, the centering pin or centering pins 24 and the sealing surface 20 are dispensed with.

Screwed into the second housing part 124 is the fuel high-pressure connection 10 which is connected to the housing bore 126 via a bore 127 of an annular intermediate piece 128 and a short radial bore 129 in the first housing part 122. The intermediate piece 128 is provided on each of its end faces with a spherical sealing surface 131. Other embodiments of the intermediate piece 128 would also be perfectly conceivable, for example with conical sealing surfaces. The intermediate piece 128 could also be omitted per se and, in this case, a prolonged fuel high-pressure connection 10 be sealingly connected directly to the tubular housing part 122.

Both in the embodiment illustrated and in the possible embodiments mentioned above, the upper second housing part 124 does not undergo any stresses caused by the fuel high pressure. This means that the upper second housing part 124 may consist of lower-grade material than the tubular first part 122 enclosing the high-pressure zone. This affords several possibilities for material combination and for the type of connection of the two housing parts 122, 124. For example, the second housing part 124, consisting of a more cost-effective metal, may be shrunk onto the first housing part 122. However, the second housing part 124 may also consist, for example, of aluminum and be connected to the first housing part 122 in an injection molding method. A second housing part 124 consisting of plastic may also be connected to the first housing part 122 by means of injection molding.

The second housing part 124 is provided in its lower region with two surfaces 130 running parallel and in the axial direction and with two step surfaces 132, via which the fuel injection valve 2 is fastened by means of a clamping fork into the cylinder head of the internal combustion engine in a way known per se.

In the fuel injection valve 2, the electromagnetic 50 for actuating the pilot valve 46 is not connected to the valve housing by means of a holding nut, as in the fuel injection valve 1, but is firmly embedded in a magnetic body 136 and, together with the latter, is screwed by means of screws 138 to the second housing part 124 having corresponding threaded holes 139. The magnetic body 136 may, again, be made, for example, from plastic and be connected to the electromagnet 50 by the injection molding method. In the exemplary embodiment illustrated, three threaded holes 139 arranged in a triangle are provided for screws 138, one of which can be seen in FIG. 4 and is located on the side of the valve longitudinal axis A other than the fuel high-pressure connection 10. The latter is arranged between the other two threaded holes 139 which cannot be seen in FIG. 4. In this embodiment, the second housing part 124 and the magnetic body 136, in its external shape, may taper triangularly in the direction of the threaded hole 139 evident from FIG. 4 and lying in the sectional plane of FIG. 4. Such an external shape is particularly favorable for installation into the internal combustion engine. However, for example, four threaded holes and connecting screws arranged in a square could also be provided.

A control device S2 is arranged in the upper region of the tubular first housing part 122. This control device S2 corresponds in functioning to the control device S1 described with reference to FIGS. 1 to 3. Above all, the deviations of this control device S2 in terms of configuration are therefore described below with reference to FIG. 5. The parts remaining the same are designated by the same reference numerals as in FIGS. 1 to 3.

Once again, sleeve-shaped spacer part 140 is arranged in the housing bore 126 with radial play and is pressed continuously with its upper end face 141 onto the lower end face 88 of the control body 74 by the relatively strong nozzle needle spring 68. In contrast to the control device Si, the nozzle needle spring 68 is prestressed between an inner step surface 143 of the spacer part 140 and a spring holding piece 146 placed onto a conical part 144 of the nozzle needle 30. The step surface of the holding piece 146, provided to support the nozzle needle spring 68, is designated by 145. The spring holding piece 146 has a conical inner surface 147. Between the conical inner surface 147 and the conical part 144 of the nozzle needle 30 is arranged a conical ring 148 which, in order to be placed onto the nozzle needle part 144, is either slotted or consists of two separate half rings. The conicity of the nozzle needle part 144, of the ring 148 and of the inner surface 147 of the spring holding piece 146 is preferably selected such that, after assembly, these parts remain clamped together.

The spacer part 140 is, again, provided with the guide surface 94 for the first piston part 31 and the guide surface 95 of widened diameter for a control sleeve 142, said guide surfaces being connected to one another by the step surface 98. In the exemplary embodiment illustrated in FIG. 5, the entire upper end face 142*o* of the control sleeve 142 is of planar configuration (in exactly the same way as the end face 72*o* of the control sleeve 72 according to FIGS. 2 and 3). In exactly the same way as the control device S1, the control sleeve 142 is shorter by the amount S than the distance between the step surface 98 and the upper end face 141 of the spacer part 140.

The spacer part 140 is additionally provided with an inner recess 155 adjoining the step surface 98. Prestressed between a step surface 156 of the recess 155 and the lower end face 142*u* of the control sleeve 142 is a compression spring 158 which, in comparison with the nozzle needle spring 68, is substantially weaker and the pressure action of which is also negligible, as compared with the fuel pressure forces. The recess 155 delimits a space 160 corresponding to the space 106 according to previous variants.

In contrast to the control device variant S1 described above, in this version the control sleeve 142 is pressed onto the lower end face 88 of the control body 74 as early as in the initial position, that is to say prior to the injection operation. This means that, from the outset, the control space 110 is connected to the high-pressure zone via the small throttle bore 150 only, thus resulting in an immediate rapid fall of the pressure in the control space 110 during the rising of the flat seat part 56 of the pilot valve stem. During the operation of closing the fuel injection valve 2, during which the flat seat part 56 of the pilot valve stem is again moved into its closing position and the pressure in the control space 110 rises again, the control sleeve 142, assisted at the same time by the compression spring 158, remains initially pressed onto the control body 74. The nozzle needle 30 is moved downward by the force acting on the second piston part 33 from above, the fuel pressure falling instantaneously in the space 160 becoming larger. During the defined fall of this pressure, the control sleeve 142 follows the piston movement. As soon as the control sleeve 142 is lifted off from the lower end face 88 of the control body 74, fuel abruptly passes from the passage 100 into the control space 110 via this new connection, and the piston part 33 is accelerated downward and also the control sleeve 142 is moved downward, until it lies on the step surface 98 and the initial gap S is canceled there. In this variant, the gap S may be larger than in the control device S1 according to FIGS. 2 and 3.

The second piston part 33, again guided with an accurate sliding fit (radial play R0 of 1 to 8 $\mu$m) in the control sleeve 142, has a conically tapering part 33*a* at its upper end. In a region surrounding this piston part 33*a*, the control sleeve 142 is equipped with a small radial throttle bore 150 which connects an annular space 149 in the spacer part 140 to the control space 110. The annular space 149 is connected via a radially arranged large throttle bore 151 to the high-pressure zone surrounding the spacer part 140. In this exemplary embodiment, the small throttle bore 150 assumes the function of the end-face depression 102 according to FIGS. 2 and 3, and the large throttle bore 151 assumes the function of the passage 100. Too rapid a closing of the injection orifices 28 can be prevented by means of the large throttle bore 151. The acceleration of the control piston during the closing operation is slightly damped, and the impact of the nozzle needle 30 on the nozzle needle seat 26 at the end of the closing operation is thereby reduced.

Figure 5:
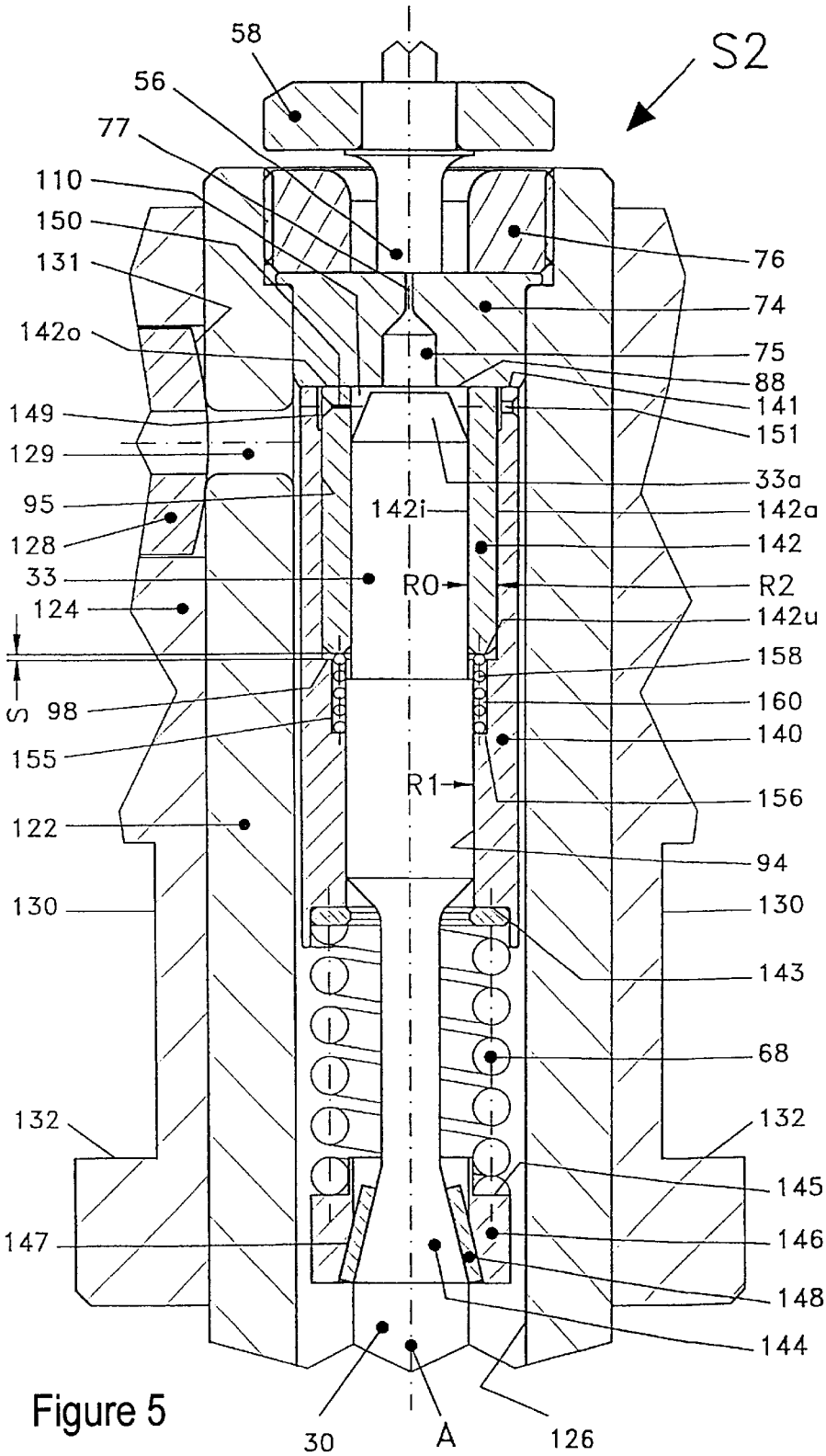
FIG. 5 shows the control device according to FIG. 4 on an enlarged scale and in longitudinal section.
Figure 6:
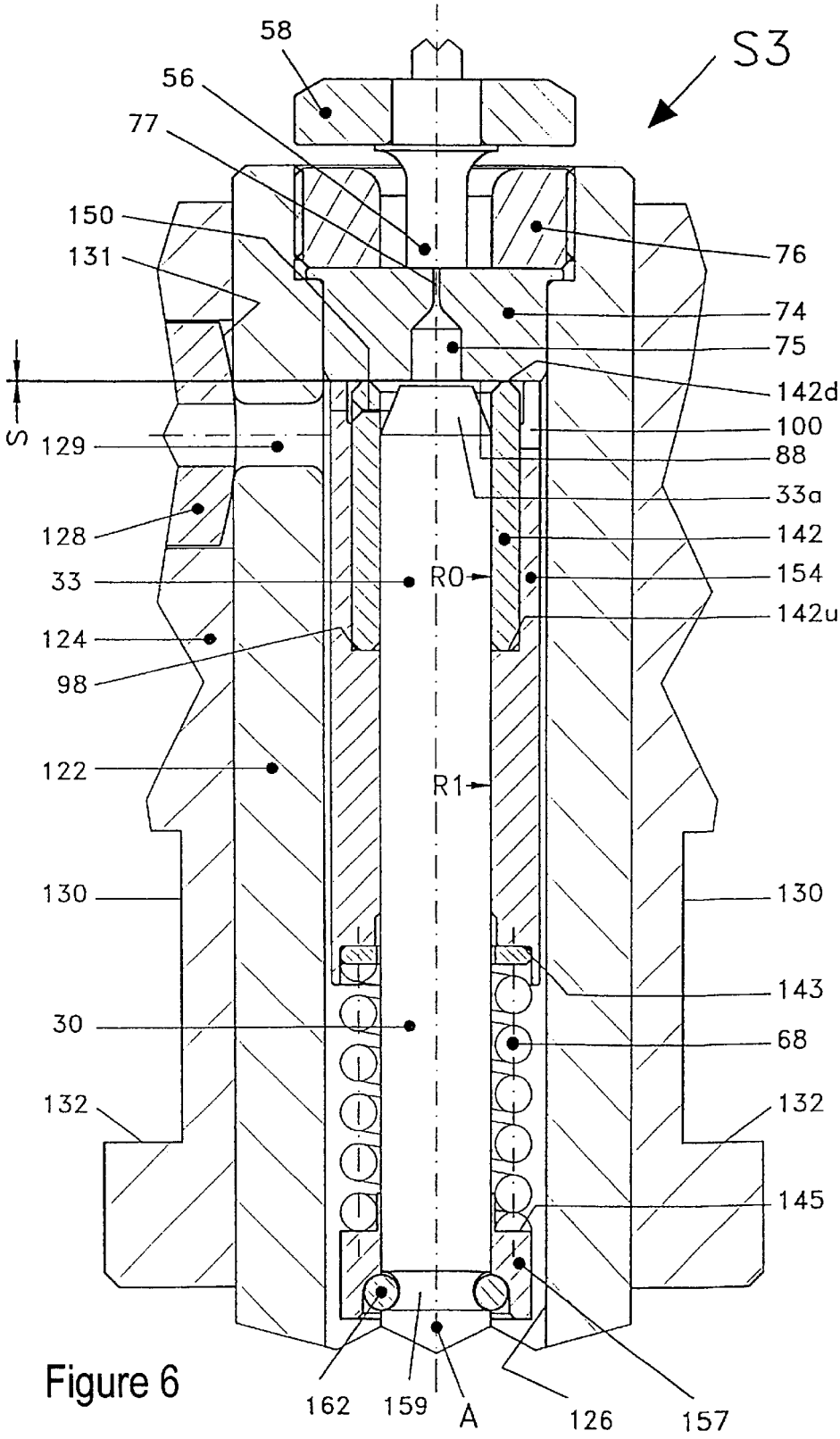
FIG. 6 shows an illustration, corresponding to that of FIG. 2 or 5, of a third embodiment of a control device for a fuel injection valve.

FIG. 6 shows a variant, designated by S3, of the control device S2 according to FIG. 5 or of the control device S1 according to FIGS. 1 to 3, in which the control sleeve 142 known from FIG. 5, and having the small throttle bore 150, is combined with a spacer part 154 which again has the passage 100 known from FIGS. 2 and 3. in this variant, the injection valve member or the nozzle needle 30 has an extremely simple shape with a uniform diameter as far as and together with the piston part 33. The nozzle needle 30 is again slidably guided in the control sleeve 142 narrowly with the radial play R0 and in the spacer part 154 with the greater radial play R1.

The spacer part 154 is again pressed continuously onto the lower end face 88 of the control body 74 by the nozzle needle spring 68 prestressed between the step surfaces 143, 145 of the spacer part 154 and of a spring holding piece 157. A slotted spring ring 162 engaging into an annular groove 159 of the nozzle needle 30 is inserted from below into the spring holding piece 157.

In contrast to the version according to FIGS. 2, 3 and 5, in this exemplary embodiment the end face of the control sleeve 142 is provided with an inner and with an outer bevel, so that only a narrow annular sealing surface 142*d* is located opposite the lower control body end face 88. This design is conducive to the closing operation and takes account of the fact that, in this variant, there is no stepping of the control piston and no space 106, as in the control devices S1 or S2. Here, too, during the closing of the outlet orifice 77 the control sleeve 142 undergoes a hydraulic force away from the lower end face 88 of the control body 74 and releases the gap S at the top, with the result that a rapid pressure rise in the control space 110 and a quick termination of the injection operation take place.

The control sleeve 142 could also be configured in an identical or similar way to the valve body 26*a* according to FIG. 3 of EP-B-0 675 281 for the same purpose (assisting the closing operation).

Figure 7:
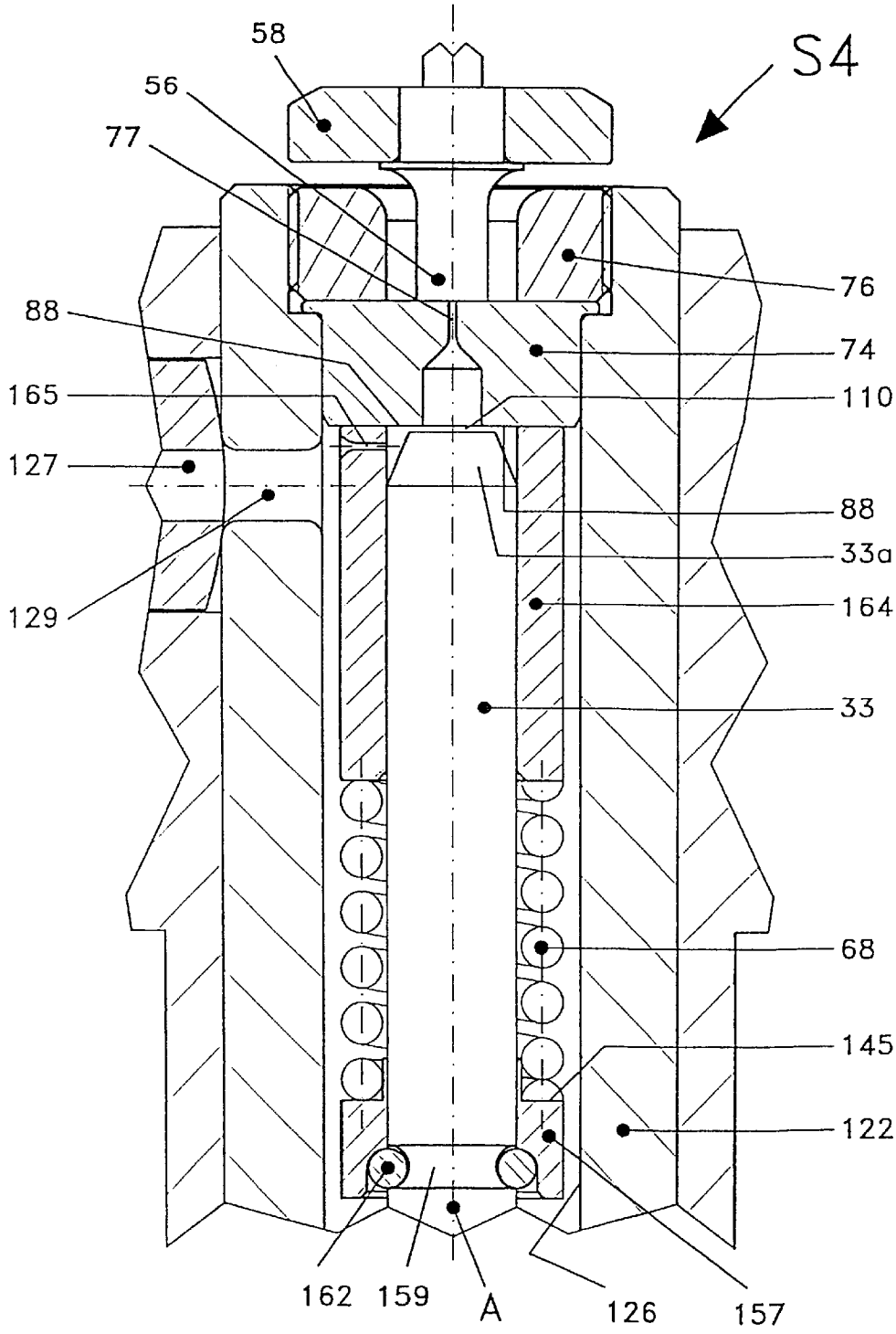
FIG. 7 shows an illustration, corresponding to that of FIG. 2 or 5, of a fourth embodiment of a control device for a fuel injection valve.

A further embodiment of a control device S4 is illustrated in FIG. 7. In this variant, a control sleeve 164 is pressed directly and continuously onto the lower end face 88 of the control body 74 by the nozzle needle spring 68. In other words, the control sleeve 164 remains stationary under the action of the nozzle needle spring 68. There is no spacer part, as in the control devices S1, S2 and S3 described above. The control sleeve 164 has a radially arranged throttle bore 165 which connects the control space 110 to the high-pressure zone surrounding the control sleeve 164. In this variant, which is extremely simple in configuration terms, it is the pressure in the control space 110 alone which controls the nozzle needle movement. This control space is defined exactly by the throttle bore 165 and the outlet orifice 77. The throttle bore 165 is of larger dimensioning, as compared with the throttle bore 150 according to FIGS. 5 and 6. Here, of course, instead of the throttle bore 165, an end-face depression (or plurality of depressions) could also form the inlet throttle connection of the high-pressure zone to the control space 110.

In this embodiment, too, the nozzle needle 30 has an extremely simple shape (no stepping of the control piston). Advantageously, here too, the spring holding piece 157 known from FIG. 6, together with the spring ring 162 engaging into an annular groove 159 of the nozzle needle 30, is used for supporting or prestressing the nozzle needle spring 68. A spacer disk 90, similar to that in FIG. 2, could also be used here to achieve the same prestressing force of a plurality of fuel injection valves.

The lower housing part 122 of the fuel injection valve 2 according to FIG. 4 has a constant diameter virtually of the entire length and can be manufactured cost-effectively from a long tubular pressure piece withstanding the high fuel high-pressure stresses.

In the two embodiments of the fuel injection valve 1, 2, the injection valve member or the nozzle needle 30 can be installed from above into the tubular housing 14 or 120. Instead of a one-piece design of injection valve member/control piston, the two parts could be connected to one another nonpositively or positively.

Fuel injection valves equipped with control devices S2, S3 or S4 according to FIGS. 5, 6 or 7 have the same advantages, already mentioned, as the fuel injection valve 1 according to FIGS. 1 to 3 provided with the control device S1 (simple and cost-effective configuration, possibility of an advantageous slender external shape, reduction in the fuel control stream flowing out into the fuel return connection 66, high-pressure zone without leakages, but, above all, elimination of disadvantages or risks present in the case of previous fuel injection valves and resulting from a possible radial offset of the control piston relative to the seat for the injection valve member). Of course, one of the control devices S2 to S4 could be used in the fuel injection valve 1 or else, conversely, the fuel injection valve 2 could be equipped with the control device S1. In all the versions, tolerances for individual parts in terms of both manufacture and assembly can be adhered to without difficulty, with the result that not only satisfactory functioning, but also functional identity in all the valves of an internal combustion engine are ensured.

In all the exemplary embodiments described above, the respective control device S1, S2, S3 or S4 was accommodated on that end of the fuel injection valve 1, 2 which faces away from the nozzle body provided with a nozzle tip 22, 121. There is, however, also the possibility of integrating the control device S1, S2, S3 or S4 very near to the nozzle body or even in the latter, with the result that the injection valve member can have a very short configuration. A small actuator for the flat seat part 56 of the pilot valve stem is necessary for this embodiment which is not illustrated in the drawing. A suitable actuator is a small electromagnet or a piezoelectric element which may be accommodated within the slender housing part 14*a* or 120. This dispenses with the thicker housing part 14*b* or 124. However, the region in which the actuator is located must lie outside the high-pressure zone. Furthermore, the hydraulic force from the outlet orifice 77 onto the flat seat part 56 must be kept as low as possible, so that a small low-power actuator can be used. This condition is fulfilled particularly effectively in the control devices S1, S2 and S3.

What is claimed is:

1. A fuel injection valve for intermittent injection of fuel into a combustion space of an internal combustion engine, said fuel injection valve comprising a housing, a valve seat element provided with injection orifices, an injection valve member for closing or opening the injection orifices, said injection valve member being installed longitudinally adjustably in the housing, and a control device for controlling an adjustment movement of the injection valve member, said control device comprising a control piston which is operatively connected to the injection valve member and which is loaded, on the one hand, by a fuel system pressure prevailing in a high-pressure zone connected to a fuel high-pressure connection and, on the other hand, by a fuel control pressure in a control space which is arranged in a longitudinal direction of the fuel injection valve between an end face of the control piston and a control body fixed to the housing and which is at least temporarily delimited radially, at least from commencement of an injection operation until commencement of a closing movement of the injection valve member, by a control sleeve having an inner guide surface which forms with the control piston a narrow sliding fit, the control pressure in the control space being capable of being controlled by an opening or closing of at least one outlet orifice in the control body by a controllable pilot valve, wherein the high-pressure zone includes a central bore which runs in a direction of a longitudinal axis of the housing and in which the injection valve member runs and which is connected, on the one hand, to the fuel high-pressure connection and, on the other hand, to a seat for the injection valve member, said seat being provided with the injection orifices, and which is closed off sealingly by the control body fixed to the housing, wherein the control piston and the injection valve member are in takeup connection to one another and wherein the control sleeve is capable of being moved transversely to the longitudinal axis of the housing and allows a radial offset of the control piston relative to the seat for the injection valve member, wherein the control sleeve is guided displaceably in a coaxial spacer part, which bears on the control body and through which passes a passage issuing into the high-pressure zone, and, in order to make a direct connection of the control body to the high-pressure zone, is longitudinally adjustable relative to said control space by the amount of a travel, the injection valve member being urged into a closing position by a closing spring which, at one end, is supported fixedly relative to the housing and, at the other end, engages on the injection valve member.

2. The fuel injection valve as claimed in claim 1, wherein a radial bore in the housing connects the central bore of the housing to the fuel high-pressure connection and forms a high-pressure supply line.

3. The fuel injection valve as claimed in claim 1, wherein the control space is connected to the high-pressure zone via a throttle connection.

4. The fuel injection valve as claimed in claim 3, defined by a stationary control sleeve which is pressed continuously onto the control body by a closing spring and which encloses the control space and is provided with a passage which forms a throttle connection and which connects the control space to the space formed between the circumference of the control sleeve and the wall of the central housing bore and belonging to the high-pressure zone, the closing spring, at one end, being supported on the control sleeve and, at the other end, engaging on the injection valve member, preferably on a step surface assigned to the injection valve member.

5. The fuel injection valve as claimed in claim 1, wherein the closing spring is supported, at one end, on the spacer part and thereby presses the spacer part onto the control body fixed to the housing.

6. The fuel injection valve as claimed in claim 1, wherein the control sleeve is capable of being adjusted longitudinally between an inner step surface of the spacer part and a lower end face of the control body, on which end face the spacer part bears with an upper end face thereof, the travel for the longitudinal adjustment of the control sleeve being defined by the difference between the length of the control sleeve and the distance between the step surface and the end face of the spacer part and is about 10 times smaller than the opening or closing stroke of the injection valve member.

7. The fuel injection valve as claimed in claim 1, wherein the control sleeve is capable of being adjusted longitudinally between an inner step surface of the spacer part and a depression in the lower end face of the control body, on which end face the spacer part bears with an upper end face, the travel for the longitudinal adjustment of the control sleeve being defined by a difference between a length of the control sleeve and a distance between the step surface and a base surface of the depression.

8. The fuel injection valve as claimed in claim 1, wherein, with the injection valve member in the closing position between two injection operations, the control sleeve is in a state of equilibrium, in which hydraulic forces acting from the fuel system pressure on the control sleeve are compensated and no further forces act on the control sleeve.

9. The fuel injection valve as claimed in claim 1, wherein there is formed, between a side of the control sleeve which faces away from the control body and an annular step surface of the control piston, a space which is delimited radially by the wall of the spacer part and the control piston and a volume of which is varied, at least shortly before and during the operation of opening and closing the injection valve member, as a result of the longitudinal adjustment of the control sleeve relative to the control body, said adjustment being caused during the opening of the at least one outlet orifice, with the result that the pressure in the space is likewise varied in relation to the remaining high-pressure zone, so that the control sleeve is assisted in a function of closing the travel shortly before and during the opening operation and of opening said travel again during the closing operation.

10. The fuel injection valve as claimed in claim 9, wherein the control piston has two piston parts of different diameter, between which the annular step surface is arranged, the control sleeve being guided with a narrow sliding fit on the piston part having the smaller diameter, and the spacer part being guided with an inner surface thereof on the piston part having a larger diameter, with a first radial play, and, with a part thereof of widened diameter, surrounding the control sleeve with a second radial play, the space between the piston part of smaller diameter and the inner surface being formed for the other piston part.

11. The fuel injection valve as claimed in claim 1, wherein the control piston has an essentially constant diameter, and the control sleeve is controlled by hydraulic forces alone which act on an annular surface facing the control body.

12. The fuel injection valve as claimed in claim 1, wherein the control sleeve radially delimits the control space in each case only from commencement of each injection operation until commencement of the movement of closing the injection valve member.

13. The fuel injection valve as claimed in claim 1, defined by a compression spring pressing the control sleeve onto the control body before and during the injection operation and at commencement of the closing operation.

14. The fuel injection valve as claimed in claim 1, wherein the injection valve member and the control piston are produced in one piece or are connected nonpositively or positively to one another.

15. The fuel injection valve as claimed in claim 14, defined by a stationary control sleeve which is pressed continuously onto the control body by a closing spring and which encloses the control space and is provided with a passage which forms a throttle connection and which connects the control space to the space formed between the circumference of the control sleeve and the wall of the central housing bore and belonging to the high-pressure zone, the closing spring, at one end, being supported on the control sleeve and, at the other end, engaging on the injection valve member, preferably on a step surface assigned to the injection valve member.

16. The fuel injection valve as claimed in claim 1, wherein a radial play of the narrow sliding fit between the inner guide surface of the control sleeve and the control piston part guided therein is 1 to 8 mm.

17. A fuel injection valve for intermittent injection of fuel into a combustion space of an internal combustion engine, said fuel injection valve comprising a housing, a valve seat element provided with injection orifices, an injection valve member for closing or opening the injection orifices, said injection valve member being installed longitudinally adjustably in the housing, and a control device for controlling an adjustment movement of the injection valve member, said control device comprising a control piston which is operatively connected to the injection valve member and which is loaded, on the one hand, by a fuel system pressure prevailing in a high-pressure zone connected to a fuel high-pressure connection and, on the other hand, by a fuel control pressure in a control space which is arranged in a longitudinal direction of the fuel injection valve between an end face of the control piston and a control body fixed to the housing and which is at least temporarily delimited radially, at least from commencement of an injection operation until commencement of a closing movement of the injection valve member, by a control sleeve having an inner guide surface which forms with the control piston a narrow sliding fit, the control pressure in the control space being capable of being controlled by an opening or closing of at least one outlet orifice in the control body by a controllable pilot valve, wherein the high-pressure zone includes a central bore which runs in a direction of a longitudinal axis of the housing and in which the injection valve member runs and which is connected, on the one hand, to the fuel high-pressure connection and, on the other hand, to a seat for the injection valve member, said seat being provided with the injection orifices, and which is closed off sealingly by the control body fixed to the housing, wherein the control piston and the injection valve member are in takeup connection to one another and wherein the control sleeve is capable of being moved transversely to the longitudinal axis of the housing and allows a radial offset of the control piston relative to the seat for the injection valve member, wherein the control space is connected to the high-pressure zone via a throttle connection, and wherein a passage provided in the spacer part, together with a throttle connection provided in the control sleeve, connect the control space to a space present between the circumference of the spacer part and the central housing bore and belonging to the high-pressure zone.

18. A fuel injection valve for intermittent injection of fuel into a combustion space of an internal combustion engine, said fuel injection valve comprising a housing, a valve seat element provided with injection orifices, an injection valve member for closing or opening the injection orifices, said injection valve member being installed longitudinally adjustably in the housing, and a control device for controlling an adjustment movement of the injection valve member, said control device comprising a control piston which is operatively connected to the injection valve member and which is loaded, on the one hand, by a fuel system pressure prevailing in a high-pressure zone connected to a fuel high-pressure connection and, on the other hand, by a fuel control pressure in a control space which is arranged in a longitudinal direction of the fuel injection valve between an end face of the control piston and a control body fixed to the housing and which is at least temporarily delimited radially, at least from commencement of an injection operation until commencement of a closing movement of the injection valve member, by a control sleeve having an inner guide surface which forms with the control piston a narrow sliding fit, the control pressure in the control space being capable of being controlled by an opening or closing of at least one outlet orifice in the control body by a controllable pilot valve, wherein the high-pressure zone includes a central bore which runs in a direction of a longitudinal axis of the housing and in which the injection valve member runs and which is connected, on the one hand, to the fuel high-pressure connection and, on the other hand, to a seat for the injection valve member, said seat being provided with the injection orifices, and which is closed off sealingly by the control body fixed to the housing, wherein the control piston and the injection valve member are in takeup connection to one another and wherein the control sleeve is capable of being moved transversely to the longitudinal axis of the housing and allows a radial offset of the control piston relative to the seat for the injection valve member, wherein a radial bore in the housing connects the central bore of the housing to the fuel high-pressure connection and forms a high-pressure supply line, and wherein the valve housing is produced in two pieces and has a first tubular housing part which projects into a second upper housing part and is connected to the second upper housing part, a radial bore which issues into the central bore being arranged in the tubular housing part and being connected to the fuel high-pressure connection.

19. A fuel injection valve for the intermittent injection of fuel into the combustion space of an internal combustion engine, said fuel injection valve comprising a housing, a valve seat element provided with injection orifices, an injection valve member for closing or opening the injection orifices, said injection valve member being installed longitudinally adjustably in the housing, and a control device for controlling adjustment movement of the injection valve member, said control device comprising a control piston which is operatively connected to the injection valve member and which is loaded, on the one hand, by the fuel system pressure prevailing in a high-pressure zone connected to a fuel high-pressure connection and, on the other hand, by the fuel control pressure in a control space which is arranged in the longitudinal direction of the fuel injection valve between an end face of the control piston and a control body fixed to the housing and is at least temporarily delimited radially, at least from commencement of the injection operation until commencement of the closing movement of the injection valve member, by a control sleeve, the inner guide surface of which forms with the control piston a narrow sliding fit, the control pressure in the control space being capable of being controlled by the opening or closing of at least one outlet orifice in the control body by a controllable pilot valve, wherein the control sleeve is guided displaceably in a coaxial spacer part, which bears on the control body and through which passes a passage issuing into the high-pressure zone, and, in order to make a direct connection of the control space to the high-pressure zone, is capable of being adjusted longitudinally relative to said control body by the amount of a travel, the injection valve member being urged into a closing position by a closing spring which, at one end, is supported fixedly relative to the housing and, at the other end, engages on the injection valve member.

20. The fuel injection valve as claimed in claim 19, wherein the control device is arranged in the high-pressure zone, which is located around the longitudinal axis of the fuel injection valve, wherein in the high pressure zone fuel is guided to the control device as well as to the injection orifices, and wherein fuel is guided to the injection orifices coaxially around the longitudinal axis of the fuel injection valve.

21. A fuel injection valve for intermittent injection of fuel into a combustion space of an internal combustion engine, said fuel injection valve comprising a housing, a valve seat element provided with injection orifices, an injection valve member for closing or opening the injection orifices, said injection valve member being installed longitudinally adjustably in the housing, and a control device for controlling an adjustment movement of the injection valve member, said control device comprising a control piston which is operatively connected to the injection valve member and which is loaded, on the one hand, by a fuel system pressure prevailing in a high-pressure zone connected to a fuel high-pressure connection and, on the other hand, by a fuel control pressure in a control space which is arranged in a longitudinal direction of the fuel injection valve following an end face of the control piston turned towards a control body fixed to the housing and comprising an end face, a sleeve shaped spacer part pressed with an annular end face onto the end face of the control body by a closing spring urging the injection valve member into a closing position, the spacer part comprising an inner cylindrical guide surface for the control piston and a passage or large throttle bore issuing into the high-pressure zone, the passage or large throttle bore being large relative to a small throttle bore or depression connecting the control space and the high-pressure zone, the control pressure in the control space being capable of being controlled by an opening or closing of a least one outlet orifice in the control body by a controllable pilot valve, wherein the high pressure-zone includes a central bore which runs in a direction of longitudinal axis of the housing and in which the injection valve member runs and which is connected, on the one hand, to the fuel high-pressure connection and, on the other hand, to a seat for the injection valve member, said seat being provided with the injection orifices, and which is closed off sealingly by the control body.

22. The fuel injection valve as claimed in claim 21, further comprising a control sleeve which is guided displaceably in the spacer part, and, in order to make a direct connection of the control space to the high-pressure zone, is longitudinally adjustable relative to said control body by an amount of travel.

23. The fuel injection valve as claimed in claim 22, wherein the control sleeve is capable of being moved transversely to the longitudinal axis of the housing.

* * * * *